US005281767A

United States Patent [19]

West et al.

[11] Patent Number: 5,281,767

[45] Date of Patent: Jan. 25, 1994

[54] REDUCED MECHANICAL STRESS BUSHING AND CONDUCTOR ROD ASSEMBLY

[75] Inventors: Edward L. West; L. Ronald Beard, both of Centralia, Mo.

[73] Assignee: A.B. Chance Company, Centralia, Mo.

[21] Appl. No.: 969,062

[22] Filed: Oct. 30, 1992

[51] Int. Cl.[5] ..... H01B 17/26; H01B 17/58

[52] U.S. Cl. ..... 174/142; 174/152 R; 174/167; 439/921

[58] Field of Search ..... 439/181-187, 439/921; 174/165, 185, 194, 31 R, 142, 152 R, 167; 29/450, 451, 800

[56] References Cited

U.S. PATENT DOCUMENTS

| | | | |
|---|---|---|---|
| 3,597,521 | 8/1971 | Tragesser . | |
| 3,602,629 | 8/1971 | Friedrich et al. . | |
| 3,617,606 | 11/1971 | Dutton . | |
| 3,659,244 | 4/1972 | McKeithan et al. . | |
| 3,666,878 | 5/1972 | Turner . | |
| 3,666,992 | 5/1972 | Goodman . | |
| 3,668,513 | 6/1972 | Tsubouchi et al. . | |
| 3,721,942 | 3/1973 | Conway . | |
| 3,824,676 | 7/1974 | Ebert . | |
| 3,883,208 | 5/1975 | Sankey et al. | 439/921 |
| 4,339,630 | 7/1982 | McQuay . | |
| 4,359,908 | 11/1982 | Perras . | |
| 4,370,514 | 1/1983 | Matthaus et al. . | |
| 4,387,266 | 6/1983 | Matthaus . | |
| 4,458,101 | 7/1984 | Cookson et al. . | |
| 4,477,692 | 10/1984 | Brealey . | |
| 4,484,019 | 11/1984 | Grotz . | |
| 4,505,033 | 3/1985 | Wheeler . | |
| 4,555,839 | 12/1985 | Thurber | 29/800 X |
| 4,670,625 | 6/1987 | Wood et al. . | |
| 4,724,284 | 2/1988 | Wheeler . | |
| 4,730,231 | 3/1988 | Tanigaki et al. . | |
| 4,760,216 | 7/1988 | Thiel et al. . | |
| 4,767,351 | 8/1988 | Patel et al. . | |
| 4,782,197 | 11/1988 | Stunzi et al. | 439/921 X |
| 4,818,967 | 4/1989 | Mikulecky . | |
| 4,847,450 | 7/1989 | Rupprecht . | |
| 4,863,392 | 9/1989 | Borgstrom et al. | 439/921 X |
| 4,867,687 | 9/1989 | Williams et al. . | |
| 4,965,407 | 10/1990 | Hamm . | |

*Primary Examiner*—Peter Dungba Vo

*Attorney, Agent, or Firm*—Hovey, Williams, Timmons & Collins

[57] ABSTRACT

An improved, failure-resistant, low mechanical stress electrical connector bushing (10) is provided which includes an elongated, central metallic conductor rod (12) with an insulative epoxy body (14) cast about the central rod (12). The rod is of substantially constant diameter throughout its length, and includes a male connection end (16) and an opposed female connection end (18). The connection end (18) presents an upset, integral, cold-forged, radially expanded terminal portion (20) having a diameter greater than the constant diameter rod (12), and presents a butt end face (24). Stress analysis confirms that the bushing (10) develops reduced, mechanical thermally induced stresses, as compared with a prior design.

5 Claims, 1 Drawing Sheet 10
12
14
16
18
20
22
24
26
28
30
32
34
36
38
A
B
C
D
E
F
G
H

REDUCED MECHANICAL STRESS BUSHING AND CONDUCTOR ROD ASSEMBLY

BACKGROUND OF THE INVENTION

1. Field of the Invention

The present invention is broadly concerned with an improved synthetic resin (e.g., epoxy) bushing assembly of the type commonly used in dead-front electrical transmission and distribution equipment (e.g., pad-mounted, air-insulated switchgear) and adapted to interconnect with conventional connector elbows. More particularly, it is concerned with such a bushing assembly which is lower in cost as compared with prior designs, and which essentially eliminates stress cracking problems attendant to thermal cycling and molding of the epoxy bushing body about the central metallic conductor rod.

2. Description of the Prior Art

Elongated, skirted bushings have long been used in conjunction with electrical transmission and distribution equipment, for the purpose of providing a convenient means for the connection and disconnection of the equipment within an electrical system. Typically, these bushings are configured to mate with external connector elbows in order to complete an electrical circuit through the associated equipment.

One type of bushing heretofore used includes a central copper rod having a male threaded connection end and an opposed female threaded connection end; an epoxy body is then cast about the rod to form the complete bushing. The central conductive rod can be a 1¼" constant diameter copper or aluminum member, but this necessitates larger skirt diameters and consequently more epoxy. Alternately, the rod ]Ray be machined down to a smaller diameter over a majority of the portion thereof and particularly the region where skirting is applied; or two different diameter sections can be joined to achieve the same end. This lowers the epoxy requirements, but this is at least somewhat offset by the attendant machining or attachment costs.

SUMMARY OF THE INVENTION

The present invention overcomes the problems outlined above, and provides an improved bushing construction which is low in cost by elimination of unnecessary machining, conductor material waste, and excessive epoxy utilization; at the same time, the bushing construction exhibits reduced mechanical stress in the outer synthetic resin body thereof, whereby cracking problems are reduced.

Broadly speaking, the bushing construction of the invention includes an elongated, metallic electrical conductor rod presenting a male threaded connection end and an opposed, female threaded connection end. This rod is of substantially constant diameter throughout the length thereof between the connection ends, but is provided with an upset, integral, radially expanded terminal portion at the female connection end which has a diameter greater than the rod constant diameter. This upset terminal portion is advantageously formed by cold forging and is configured to present a butt end face having a diameter of at least about 1¼", with the axial length of the terminal portion being up to about ½".

A body of insulative synthetic resin material is molded about the rod between the connection ends, with the radially expanded terminal portion being imbedded within the synthetic resin material with only the butt end face and a short section (0.050 in.) thereof exposed. This insulative body is preferably formed of epoxy and includes a radially enlarged collar segment intermediate the rod ends with respective tapered sections extending from the collar segment toward each of the connection ends.

In preferred forms, the rod is formed of either copper or aluminum, and the axial length of the terminal end portion is up to about ¼". An arcuate transition is provided between the face of the terminal portion remote from the butt end face, and the adjacent portion of the constant diameter rod.

DETAILED DESCRIPTION OF THE PREFERRED EMBODIMENTS

Figures 1, 2, 3, 4, 5:
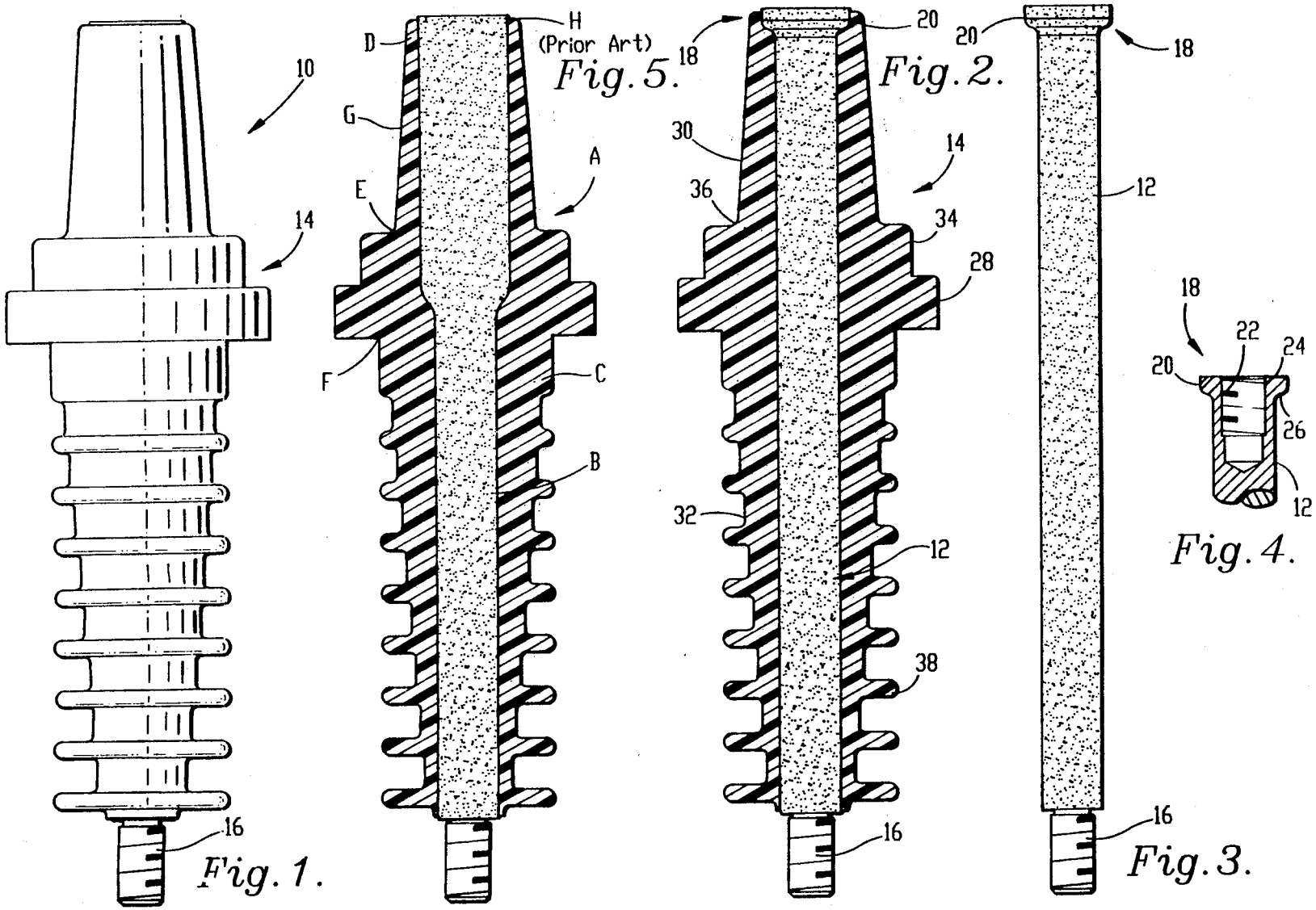
Fig. 5. (Prior Art)
FIG. 1 is an elevational view of the preferred bushing construction in accordance with the invention.
FIG. 2 is a vertical sectional view of the bushing illustrated in FIG. 1.
FIG. 3 is an elevational view of the central metallic conductor rod forming a part of the bushing construction.
FIG. 4 is a fragmentary view in vertical section illustrating the female connection end of the central bushing rod.
FIG. 5 is a vertical sectional view of a prior art bushing construction, of the type having a machined central conductive rod with an enlarged female connection end.

Turning now to the drawings, and particularly FIG. 1, an electrical bushing 10 is illustrated. The bushing 10 includes a central, metallic conductive rod 12, together with a body 14 of insulative epoxy molded about the rod 12.

In more detail, it will be seen that the rod 12 is of integral construction and is preferably formed of copper having a sandblasted outer surface. The rod presents a threaded male connection end 16 as well as an opposed female threaded connection end 18. The rod is of substantially constant diameter along the length thereof between the ends 16 and 18. As best seen in FIGS. 3 and 4, the female connection end 18 includes a radially enlarged, cold-forged, integral terminal portion 20, as well as an inwardly extending threaded bore 22. The enlarged terminal portion 20 presents an annular butt end face 24 which preferably has an outer diameter of at least about 1¼". Moreover, a double arcuate transition region 26 is provided between the rear face of terminal portion 20 remote from face 24 and the adjacent section of the constant diameter of rod 12.

The epoxy body 14 is integrally gel-cast about rod 12 in direct contact therewith. Thus the bushing of the invention avoids the use of ah intermediate elastomeric or similar coating between the rod 12 and the body 14. It will be seen that the body 14 includes a radially expanded collar segment 28 as well as tapered sections 30 and 32 respectively leading from the segment 28 to the ends 18 and 16. In this respect, it will be seen that the tapered section 30 includes a stepped region 34 having a lesser diameter than the adjacent collar 28, with an arcuate transition zone 36 between the inner margin of the region 34 and the tapered extension leading to female connection end 18. On the other hand, the tapered region 32 includes a plurality of radially outwardly extending skirts 38 between the collar segment 28 and male connection end 16. The body 14 surrounds almost the entirety of the sidewall and transition of the terminal portion 20 as shown, leaving the annular butt end face 24 exposed. At the opposite end of the bushing, the epoxy body 14 extends almost to the end of the constant diameter rod 12, prior to the necked-down adjacent section and threaded end 16 of the rod. The body 14 is cast about the rod 12 using entirely conventional techniques.

Attention is next directed to FIG. 5 which illustrates a prior art bushing A having a central, machined, surface-sandblasted conductor rod B therein, as well as an epoxy body C surrounding the rod B. It will be noted in this respect that the rod B is machined to assume a smaller diameter along the skirted portion of the body C, and is of a greater diameter leading to the female connection end D thereof. It has been found that the radius region E of this prior type of bushing is particularly prone to high mechanical stress. Moreover, the necessity of machining the central conductive rod B adds to manufacturing and material costs.

A comparative, computer stress analysis has been undertaken to determine the thermally-induced mechanical stresses in the bushing 10 of the invention, as compared with the bushing A of the prior art. A commercially available finite element analysis computer program (the COSMOS program commercialized by Structural Research and Analysis Corp., Santa Monica, Calif.) was used in this study. It was assumed that the epoxy body was subjected to zero stress at 100° C., and that stresses were developed as the body cooled to −40° C. The results of this comparative analysis for both hoop stress (in epoxy body, perpendicular to any radius and tangential the circumference of the epoxy body) and principal stress (maximum tensile stress in epoxy body regardless of stress direction) are set forth below, at four separate locations along the lengths of the epoxy bodies, namely the radius E, behind the collar segment at point F, along the length of the tapered barrel section G leading to the female connection end, and at the annular butt end face of the epoxy, point H.

| Stress Type/Value (PSI) | Prior Art Bushing | Bushing of Invention |
|---|---|---|
| Hoop Stress | | |
| Region E | 1050 | 291 |
| Region F | 371 | 291 |
| Region G | 1050 | 1050 |
| Region H | 1050 | 1050 |

-continued

| Stress Type/Value (PSI) | Prior Art Bushing | Bushing of Invention |
|---|---|---|
| Principal Stress | | |
| Region E | 1440 | 986 |
| Region F | 787 | 336 |
| Region G | 1110 | 986 |
| Region H | 1110 | 986 |

This analysis demonstrates that thermally-induced stresses are reduced in many cases with the bushing construction of the invention, and in no case are these stresses greater, as compared with the prior art design.

We claim:

1. An electrical connector bushing, comprising:

an elongated, metallic electrical conductor rod presenting a male threaded connection end and an opposed, female threaded connection end, and having a substantially constant diameter between said connection ends, said female connection end being configured to present an upset, integral, radially expanded terminal portion having a diameter greater than said rod constant diameter and an annular butt end face having a diameter of at least about 1¼", the terminal portion including a side wall having an axial length of up to about ½"; and a body of insulative synthetic resin material molded about said rod between said connection ends, said body surrounding substantially the entire length of the side wall of the terminal portion so that only the annular butt end face of the terminal portion is exposed by the body, the body including a radially enlarged collar segment spaced axially from the terminal portion of the conductor rod, and respective tapered sections extending from said collar segment towards each of said connection ends, wherein one of the tapered sections includes a plurality of radially outward extending skirts, and the other tapered section includes a stepped region spaced axially from the terminal portion of the conductor rod and having a diameter smaller than the collar.

2. The connector bushing of claim 1, said rod being formed of a metal selected from the group consisting of copper and aluminum.

3. The connector bushing of claim 1, said body being formed of epoxy.

4. The connector bushing of claim 1, said axial length being up to about 174".

5. The connector bushing of claim 1, further comprising a double arcuate transition between the face of said terminal portion remote from said butt end face and said constant diameter rod.

* * * * *